US009373911B2

(12) United States Patent
Lo

(10) Patent No.: US 9,373,911 B2
(45) Date of Patent: Jun. 21, 2016

(54) WATERPROOF AUDIO CONNECTOR

(71) Applicant: SIMULA TECHNOLOGY INC., Taoyuan, Taoyuan County (TW)

(72) Inventor: Chin Lung Lo, Taoyuan (TW)

(73) Assignee: SIMULA TECHNOLOGY INC., Taoyuan, Taoyuan County (TW)

( * ) Notice: Subject to any disclaimer, the term of this patent is extended or adjusted under 35 U.S.C. 154(b) by 0 days.

(21) Appl. No.: 14/598,463

(22) Filed: Jan. 16, 2015

(65) Prior Publication Data

US 2016/0056568 A1 Feb. 25, 2016

(30) Foreign Application Priority Data

Aug. 20, 2014 (TW) ..... 103214862

(51) Int. Cl.

| | |
|---|---|
| ***H01R 13/40*** | (2006.01) |
| ***H01R 13/52*** | (2006.01) |
| ***H01R 13/66*** | (2006.01) |
| ***H01R 24/58*** | (2011.01) |
| *H01R 107/00* | (2006.01) |

(52) U.S. Cl.

CPC ..... *H01R 13/5202* (2013.01); *H01R 13/665* (2013.01); *H01R 24/58* (2013.01); *H01R 2107/00* (2013.01)

(58) Field of Classification Search

CPC .. H01R 13/5202; H01R 13/665; H01R 24/58; H01R 13/521; H01R 13/5216; H01R 2107/00

USPC ..... 439/587, 589, 936

See application file for complete search history.

(56) References Cited

U.S. PATENT DOCUMENTS

| | | | | |
|---|---|---|---|---|
| 5,551,892 A * | 9/1996 | Endo | H01R 13/443 | 439/587 |
| 8,449,317 B1 * | 5/2013 | Dang | H01R 13/502 | 439/449 |
| 8,770,989 B2 * | 7/2014 | Ohhashi | H01R 13/5202 | 439/589 |
| 8,915,754 B2 * | 12/2014 | Montena | H01R 9/05 | 439/578 |
| 9,225,103 B2 * | 12/2015 | Okamoto | H01R 13/5202 | |

* cited by examiner

*Primary Examiner* — Khiem Nguyen
(74) *Attorney, Agent, or Firm* — Bacon & Thomas, PLLC

(57) ABSTRACT

The present invention is to provide a waterproof audio connector which includes an isolation base mounted in the electronic device, having an inserting port and an assembly port respectively at a front end and a rear end thereof, having a plurality of first assembly slots longitudinally and concavely disposed at an inner surface thereof between the two ports; a plurality of signal terminals each having a contacting portion at the end thereof and fastened with the first assembly slot corresponding thereto; an isolation plate having a side surface abutted against outer edges of the first assembly slots and forming a filler space between another side surface thereof and an edge of the assembly port; and a waterproof sealant formed by waterproof glue which is filled into the filler space and solidified later, so as to watertightly seal all gaps among the signal terminals, the isolation plate and the assembly port.

15 Claims, 4 Drawing Sheets

WATERPROOF AUDIO CONNECTOR

FIELD OF THE INVENTION

The present invention relates to an audio connector, more particularly to a waterproof audio connector having a simplified structure for watertightly sealing all gaps among signal terminals, an isolation plate and an assembly port of an isolation base thereof in an easy way, so as to easily assemble the audio connector and effectively improve the waterproof function thereof.

BACKGROUND OF THE INVENTION

As various consumer electronic devices are switched from old to new and become more and more popular, the consumer pay more and more attention to multimedia function of the consumer electronic device. Currently, most consumer electronic devices are provided with audio connectors, and the consumer can plug an audio line plug (abbreviated as audio plug in following paragraph) of a broadcasting device such as earphones, loudspeaker, etc., into the consumer electronic device, so that audio data outputted from the consumer electronic device can be broadcasted by the above-mentioned broadcasting device.

Generally speaking, a structure of the audio plug is in a slightly cylindrical shape, and the audio plug is provided with a plurality of audio electrodes which respectively transmit different signals (such as a left channel signal, a right channel signal, a microphone signal, a switch signal, etc.). When the consumer inserts the audio plug into a plug slot of the audio connector, the audio electrodes on the audio plug must be precisely and electrically connected with a plurality of signal terminals of the audio connector for transmitting signals correctly, whereby the consumer electronic device can transmit the audio signal to the broadcasting device via the audio plug and the audio line in sequence and play the audio data by the broadcasting device.

However, as the consumer uses the electronic device more frequently, condition that the electronic device is splashed by liquid or fallen into water is increased correspondingly. When the aforesaid condition occurs, it is inevitable that the electronic device may be penetrated by the liquid even though the electronic device is removed or picked up immediately. If the audio connector without waterproof design is penetrated by the liquid, the liquid may penetrates the electronic device via the plug slot and the electronic device may be damaged due to the circuit board being short circuit or damp.

In order to solve the above-mentioned problems, some companies provide a traditional waterproof audio connector. Please refer to FIG. 1. The traditional audio connector 1 includes a plurality of signal terminals 11, an isolation main body 13, and a side cover 15. The isolation main body 13 is provided with a plurality of terminal slots 131 disposed at a long side surface thereof, to position the signal terminals 11. The openings of the terminal slots 131 are vertically extended toward an external wall surface of the isolation main body 13, so as to form terminal slot protection walls 133 flushing with each other. An outline of the side cover 15 corresponds to an inner outline of the terminal slot protection walls 133 of the isolation main body 13, and the side cover 15 is provided with a plurality of through structures 151 therethrough. When the openings of the terminal slots 131 are shielded by the side cover 15 at the same time, the soldering parts 111 of the signal terminals 11 can be exposed out of the isolation main body 13 via the through structures 151. The position of the upper surface of the side cover 15 is still lower than a top position of the terminal slot protection wall 133, so the recessed area formed between the side cover 15 and the terminal slot protection wall 133 can be defined as a waterproof glue material accommodating groove, and a waterproof glue material is filled into the accommodating groove to fill all possible gaps fully to achieve the purpose of waterproof.

However, as shown in FIG. 1 clearly, the structure of the traditional audio connector 1 is very complicated and not very friendly for manufacturing assembly. Because the signal terminals 11 separately transmit different audio signals (such as left channel signal, right channel signal, microphone signal, etc.), positions and structures of the signal terminals 11 are different from each other in order to correctly connect two ends of the signal terminals 11 with the circuit board and the audio plug inside the electronic device electrically, but such design increases the difficulty in assembly efficiently. In addition, in other type of the audio connector, in order to enable the signal terminals to be precisely soldered to the corresponding circuit contact point, the signal terminals are extended and crisscrossed with each other, and such design affects the manufacturing cost and yield rate of the audio connector. It means that the structure of the signal terminals must be adjusted for forming "waterproof scheme" of the traditional audio connector, and the problems of complicated structure and difficult assembly are occurred correspondingly.

To sum up, in the design of traditional waterproof audio connector, a waterproof structure is disposed between the signal terminals and the isolation base, but the waterproof structure has complicated design and causes difficult assembly, and may further lead to the problem of a bad waterproof effect. Therefore, what is need is to design an audio connector having a simple waterproof structure, to enable the waterproof audio connector to be assembled more easily and improve the waterproof effect.

SUMMARY OF THE INVENTION

In order to solve the above-mentioned problems in the traditional audio connector, the inventor design a waterproof audio connector of the present disclosure based on long-term practice experience, experiments and tests.

An objective of the present disclosure is to provide a waterproof audio connector which is adapted for an electronic device (such as a cell phone or a computer). The waterproof audio connector includes an isolation base, a plurality of signal terminals, an isolation plate and a waterproof sealant. The isolation base is mounted in the electronic device, and the isolation base is provided with an inserting port at a front end thereof and an assembly port at rear end thereof. The isolation base is provided with a plurality of first assembly slots longitudinally and concavely disposed at an inner surface thereof, and two ends of each of first assembly slots are communicated with the inserting port and the assembly port respectively. A structure of each of signal terminals matches with a structure of each of the first assembly slots, each of the signal terminals is provided with a contacting portion at the end thereof, and the contacting portion is fastened with the first assembly slot corresponding thereto. The structure of the isolation plate matches with the structure of the assembly port, a side surface of the isolation plate is abutted against outer edges of the first assembly slots, and a filler space is formed between another side surface of the isolation plate and an edge of the assembly port. The other ends of the signal terminals are exposed out of the isolation plate and the assembly port to be soldered on a circuit board inside the electronic device. The waterproof sealant is formed by waterproof glue which is filled into the filler space and solidified later. The waterproof sealant can watertightly seal all gaps between the isolation plate and edges of the assembly port and watertightly seal the portions of the signal terminals near the other ends of the signal terminals.

Therefore, even if the first assembly slot is penetrated by moisture or humidity from outside via the inserting port, because the gaps between the isolation plate and the edges of the assembly port are sealed by the waterproof sealant, the circuit board can be prevented from being damaged due to short circuit or damp. In addition, the signal terminals are embedded into the first assembly slots via the assembly port, so the waterproof structure is simplified and it is easier to assemble the audio connector, and the waterproof function can be further improved.

BRIEF DESCRIPTION OF THE DRAWINGS

The detailed structure, operating principle and effects of the present disclosure will now be described in more details hereinafter with reference to the accompanying drawings that show various embodiments of the present disclosure as follows.

DETAILED DESCRIPTION OF THE PREFERRED EMBODIMENTS

Figure 1:
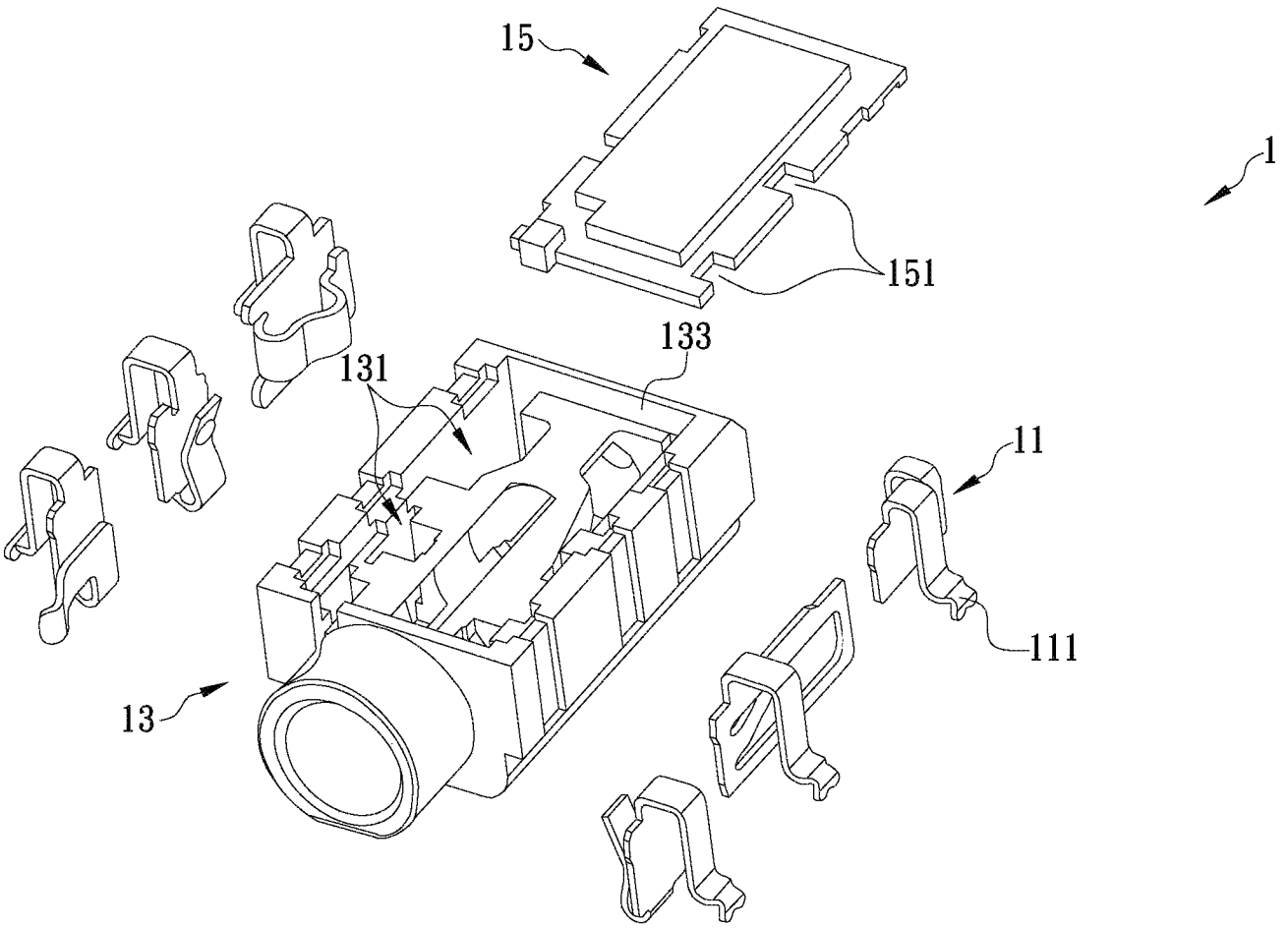
FIG. 1(Prior Art)
FIG. 1 is a structural schematic view of a traditional audio connector.

Reference will now be made in detail to the exemplary embodiments of the present disclosure, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this disclosure will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way. The same reference numbers are used in the drawings and the description to refer to the same or like parts.

It will be understood that, although the terms 'first', 'second', 'third', etc., may be used herein to describe various elements, these elements should not be limited by these terms. The terms are used only for the purpose of distinguishing one component from another component. Thus, a first element discussed below could be termed a second element without departing from the teachings of embodiments. As used herein, the term "or" includes any and all combinations of one or more of the associated listed items.

The present disclosure illustrates a waterproof audio connector. Please refer to FIG. 2 and FIG. 3 which show a first preferred embodiment of the present disclosure. The audio connector 2 is adapted for an electronic device (not shown in FIGs), and includes an isolation base 21, a plurality of signal terminals 23, an isolation plate 25 and a waterproof sealant 27. The isolation base 21 is provided with an inserting port 211 at a front end thereof and an assembly port 213 at a rear end thereof. The isolation base 21 is provided with a plurality of first assembly slots 215 longitudinally and concavely disposed at an inner surface thereof, two ends of each of the first assembly slots 215 are communicated with the inserting port 211 and the assembly port 213 respectively. A structure of the inserting port 211 matches with an audio plug 4, so an end of the audio plug 4 can be inserted into the inserting port 211 to enable a plurality of audio electrodes 41 on the audio plug 4 to be positioned at a plurality of preset locations in the inserting port 211.

Figure 2:
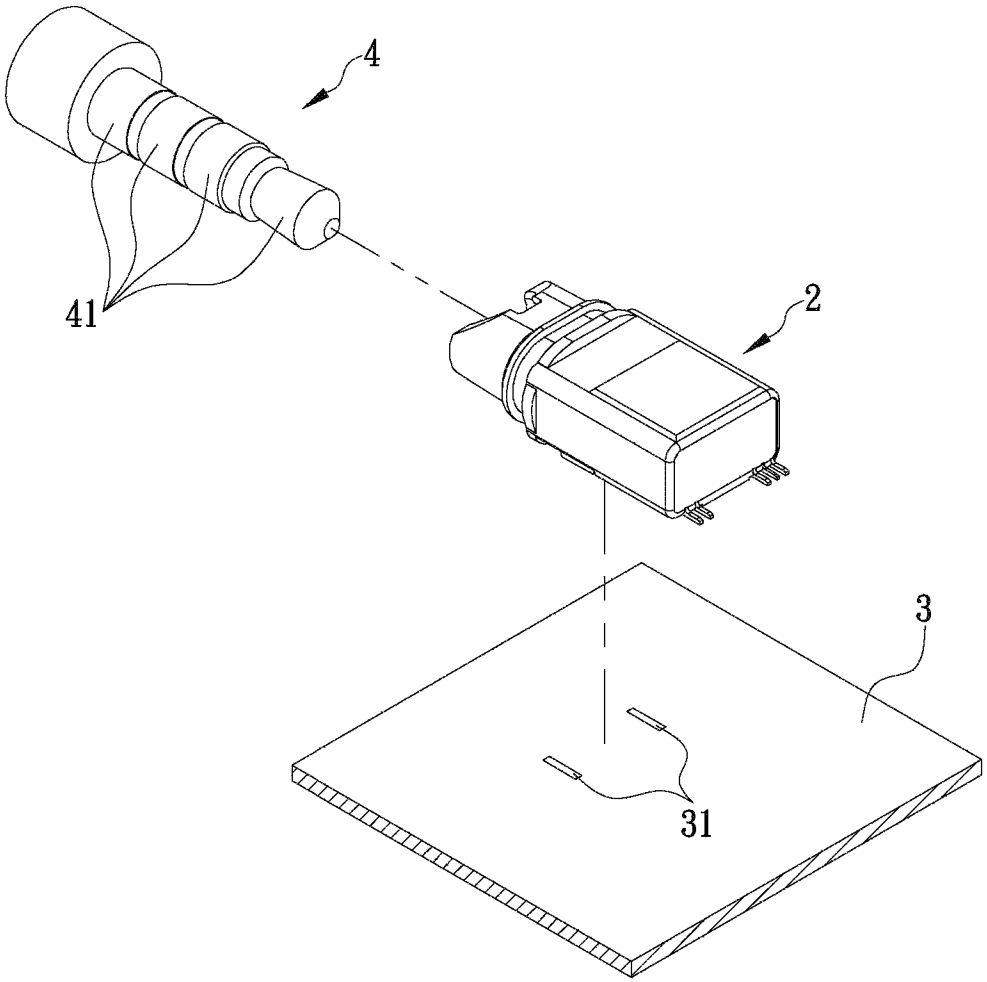
FIG. 2 is an assembly schematic view of an audio connector of the present disclosure.
Figure 3:
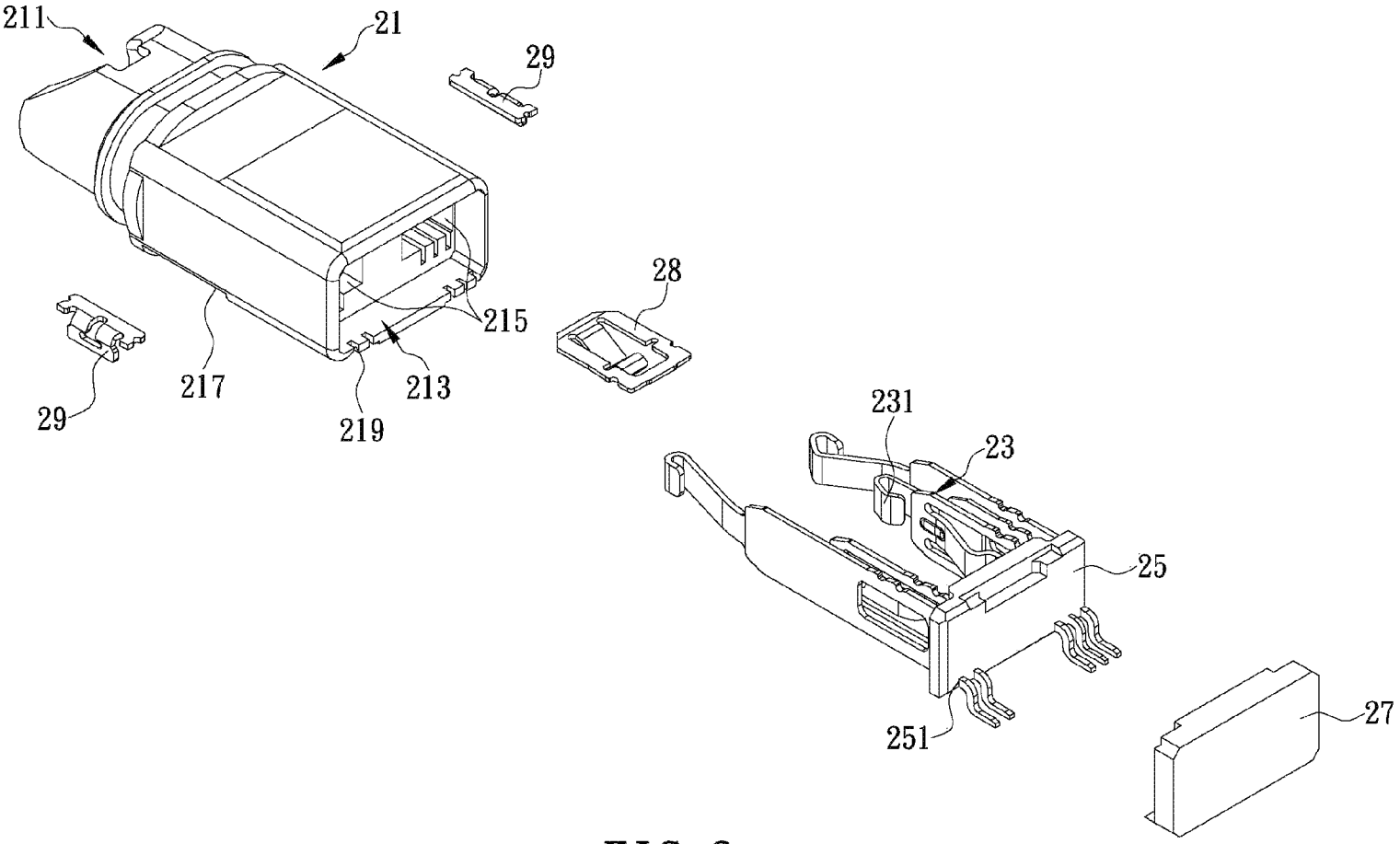
FIG. 3 is an exploded view of a structure of the audio connector of the present disclosure.

As shown in FIG. 2 and FIG. 3, a structure of each of the signal terminals 23 matches with a structure of each of the first assembly slots 215, each of the signal terminals 23 is provided with a contacting portion 231 at an end thereof, and the contacting portions 231 are fastened with the first assembly slots 215 respectively to be electrically connected with the audio electrodes 41 at the preset locations, and other ends of the contacting portions 231 can be exposed out of the assembly port 213 to be soldered on a circuit board 3 in the electronic device. Moreover, the ends of signal terminals 23 are parallel with each other and fastened into the first assembly slots 215 respectively, and the other ends of the signal terminals 23 are parallel with each other and exposed out of the assembly port 213 to be soldered on the circuit board 3. Therefore, the signal terminals 23 can be designed in simpler structures and have better assembly convenience to reduce manufacturing cost of the audio connector and improve a yield rate of the audio connector.

Figure 4:
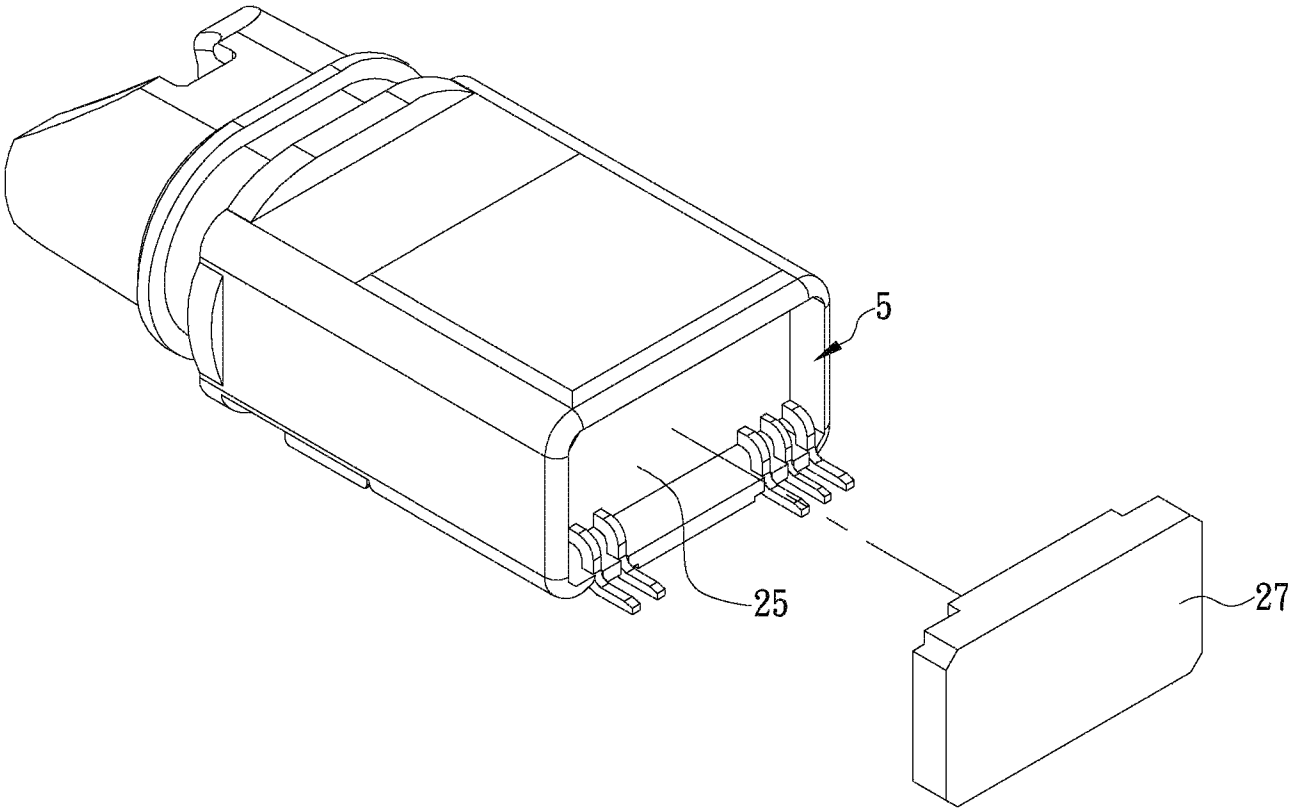
FIG. 4 is a schematic view of filler space of the audio connector of the present disclosure.

Please refer to FIG. 2, FIG. 3 and FIG. 4. The structure of the isolation plate 25 matches with the assembly port 213, a side surface of the isolation plate 25 is abutted against outer edges of the first assembly slots 215, and a filler space 5 is formed between other side surfaces of the isolation plate 25 and edges of the assembly port 213. Other ends of the signal terminals 23 can be exposed out of the isolation plate 25 and the assembly port 213 to be soldered on the circuit board 3 in the electronic device.

As shown in FIG. 2, FIG. 3 and FIG. 4, the waterproof sealant 27 is formed by filling waterproof glue made of epoxy resin material into the filler space 5, and then heating the whole audio connector 2 to solidify the waterproof sealant 27 in the filler space 5. The waterproof sealant 27 can watertightly seal all gaps between the isolation plate 25 and edges of the assembly port 213 and watertightly seal portions of the signal terminals 23 near the other ends of the signal terminals 23.

Therefore, even if the first assembly slots 215 are penetrated by moisture or humidity from outside via the inserting port 211, because the rear end of the isolation base 21 is sealed by the isolation plate 25 and the waterproof sealant 27, the circuit board 3 can be prevented from being damaged due to short circuit or damp. In addition, the signal terminals 23 are embedded into the first assembly slots 215 via the assembly port 213, so the waterproof structure is simplified and it is easier to assemble the audio connector 2, and the waterproof function is further improved.

In other embodiment of the present disclosure, as shown in FIG. 2 and FIG. 3, The isolation plate 25 is provided with slots 251 at a bottom edge thereof corresponding to the plurality of first assembly slots 215, and other ends of each of signal terminals 23 can be passed the corresponding slots 251 and exposed out of the isolation plate 25 and the assembly port 213 to be fixed on the circuit board 3 by soldering, so as to separate the signal terminals 23 for preventing from contacting with each other and causing short circuit. In other embodiment, the slots 251 can also be disposed above the bottom edge, and when the other ends of the signal terminals 23 are passed through the slots 251 respectively and exposed out of the isolation plate 25 and the assembly port 213, the other ends of the signal terminals 23 can be bent downwardly to be fixed on the circuit board 3 by soldering.

In other embodiment of the present disclosure, as shown in FIG. 2 and FIG. 3, The isolation base 21 is provided with a plurality of fastening slots 219 concavely disposed at a bottom edge of the assembly port 213 thereof and corresponding to the first assembly slots 215 respectively, so other end of each of signal terminals 23 can be passed through the fastening slot 219 corresponding thereto and exposed out of the isolation plate 25 and the assembly port 213, When the other ends of the signal terminals 23 are exposed out of the isolation plate 25 and the assembly port 213, the other ends of the signal terminals 23 can be fastened to the fastening slots 219, so as to separate the signal terminals 23 for preventing from contacting with each other and causing short circuit.

In other embodiment of the present disclosure, as shown in FIG. 2 and FIG. 3, the audio connector 2 further includes two fixing terminals 29, and the isolation base 21 is provided with second assembly slots 217 at right side and left side thereof and near bottom side thereof respectively. A structure of each of the second assembly slots 217 matches with an end of the fixing terminal 29. When the ends of the fixing terminals 29 are fastened into the second assembly slots 217, other ends of the fixing terminals 29 can be fastened to fixing portions 31 respectively, and a structure of each of the fixing portion 31 matches with structure of other end of each of the fixing terminals 29.

In other embodiment of the present disclosure, as shown in FIG. 2 and FIG. 3, the audio connector 2 further includes a grip slipper 28 which is fastened in the first assembly slot 215. When the audio plug 4 is inserted into the inserting port 211, the grip slipper 28 can provide a stronger insertion force and firmly nip the portion of the audio plug 4 near the end of the audio plug 4, so that the grip slipper 28 can ensure the audio electrodes 41 on the audio plug 4 to precisely and electrically connected with the signal terminals 23 and not easily be loosened due to effect of an external force.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A waterproof audio connector, applied to an electronic device, the waterproof audio connector comprising:

an isolation base mounted inside the electronic device, provided with an inserting port at a front end thereof, an assembly port at a rear end thereof and a plurality of first assembly slots concavely disposed on an inner surface thereof and along a longitudinal direction thereof, wherein two ends of each of the first assembly slots are communicated with the inserting port and the assembly port, respectively;

a plurality of signal terminals each having a structure matching with the structure of the first assembly slot and an end inserted into the first assembly slot correspondingly via the assembly port;

an isolation plate having a structure matching with the structure of the assembly port and a side surface abutted against outer edges of the first assembly slots, so as to form a filler space between another side surface of the isolation plate and edges of the assembly port, wherein other ends of the signal terminals can be exposed out of the isolation plate and the assembly port to be soldered on a circuit board inside the electronic device; and a waterproof sealant formed by waterproof glue which is filled into the filler space and solidified later, so as to watertightly seal gaps between the isolation plate and the assembly port and watertightly seal gaps between the first assembly slots and portions of the signal terminals near the other end thereof.

2. The waterproof audio connector as defined in claim 1, wherein the isolation plate is provided with slots at a bottom edge thereof corresponding to the first assembly slots, and other end of each of the signal terminals can be passed through the slot corresponding thereto and exposed out of the isolation plate and the assembly port.

3. The waterproof audio connector as defined in claim 1, wherein the isolation base is provided with a plurality of fastening slots concavely disposed at a bottom edge of assembly port thereof and corresponding to the plurality of first assembly slots respectively, and other end of each of the signal terminals can be passed through the fastening slot corresponding thereto and exposed out of the isolation plate and the assembly port.

4. The waterproof audio connector as defined in claim 1, further comprising a fixing terminal, and the isolation base provided with second assembly slots at right side and left side thereof and near bottom side thereof respectively, wherein each of the second assembly slot has a structure matching with the structure of an end of the fixing terminal such that, when the end of the fixing terminal is fastened into the second assembly slot, other end of the fixing terminal can be fastened to a fixing portion of the circuit board.

5. The waterproof audio connector as defined in claim 2, further comprising a fixing terminal, and the isolation base provided with second assembly slots at right side and left side thereof and near bottom side thereof respectively, wherein each of the second assembly slot has a structure matching with the structure of an end of the fixing terminal such that, when the end of the fixing terminal is fastened into the second assembly slot, other end of the fixing terminal can be fastened to a fixing portion of the circuit board.

6. The waterproof audio connector as defined in claim 3, further comprising a fixing terminal, and the isolation base provided with second assembly slots at right side and left side thereof and near bottom side thereof respectively, wherein each of the second assembly slot has a structure matching with the structure of an end of the fixing terminal such that, when the end of the fixing terminal is fastened into the second assembly slot, other end of the fixing terminal can be fastened to a fixing portion of the circuit board.

7. The waterproof audio connector as defined in claim 4, further comprising a grip slipper which is fastened into the first assembly slot, wherein the grip slipper can firmly nip a portion of an end of an audio plug when the audio plug is inserted into the inserting port.

8. The waterproof audio connector as defined in claim 5, further comprising a grip slipper which is fastened into the first assembly slot, wherein the grip slipper can firmly nip a portion of an end of an audio plug when the audio plug is inserted into the inserting port.

9. The waterproof audio connector as defined in claim 6, further comprising a grip slipper which is fastened into the first assembly slot, wherein the grip slipper can firmly nip a portion of an end of an audio plug when the audio plug is inserted into the inserting port.

10. The waterproof audio connector as defined in claim 7, wherein the waterproof sealant is made of epoxy resin material.

11. The waterproof audio connector as defined in claim 8, wherein the waterproof sealant is made of epoxy resin material.

12. The waterproof audio connector as defined in claim 9, wherein the waterproof sealant is made of epoxy resin material.

13. The waterproof audio connector as defined in claim 10, wherein a structure of the inserting port matches with that of the audio plug.

14. The waterproof audio connector as defined in claim 11, wherein a structure of the inserting port matches with that of the audio plug.

15. The waterproof audio connector as defined in claim 12, wherein a structure of the inserting port matches with that of the audio plug.

* * * * *